US005118060A

United States Patent [19]

Spronken

[11] Patent Number: 5,118,060

[45] Date of Patent: Jun. 2, 1992

[54] ADJUSTABLE BRACKET FOR BUILDING CONSTRUCTION

[76] Inventor: John R. Spronken, 95 Chelsea Street N.W., Calgary, Alberta, Canada, T2K 1P1

[21] Appl. No.: 593,979

[22] Filed: Oct. 9, 1990

[51] Int. Cl.[5] ..... E04H 1/00

[52] U.S. Cl. ..... 248/218.4; 248/219.1; 248/219.3; 248/222.1; 52/40; 52/235

[58] Field of Search ..... 248/284, 218.4, 219.1, 248/219.3, 220.2, 222.1, 222.3, 284, 220.4, 242; 52/235, 483, 489, 40

[56] References Cited

U.S. PATENT DOCUMENTS 3,114,531 12/1963 Weber ..... 248/242
3,905,572 9/1975 Hikai ..... 248/242

FOREIGN PATENT DOCUMENTS 156372 10/1956 Sweden ..... 248/284

*Primary Examiner*—John E. Murtagh

[57] ABSTRACT

An adjustable support bracket assembly is described for supporting a building wallpanel or other heavy article on a vertical support structure, e.g. a column. The assembly includes a pivot pin which is fixed to the vertical support structure, e.g. welded to an inner edge face of a column with a portion of the pin projecting laterally beyond an edge of the column. A substantially horizontal support member is pivotally supported at the inner end thereof on the pivot pin and has a load bearing portion extending outwardly beyond the outer edge of the vertical support structure. This horizontal support member also includes a pivot arm portion projecting upwardly or downwardly from the horizontal portion and having a threaded hole in the pivot are portion remote from the horizontal portion. A threaded bolt is mounted in the threaded hole of the pivot arm and this bolt is adapted to engage the vertical support structure, e.g. column, such that rotation of the bolt results in upward or downward movement of the load bearing portion.

4 Claims, 3 Drawing Sheets

ADJUSTABLE BRACKET FOR BUILDING CONSTRUCTION

BACKGROUND OF THE INVENTION

This invention relates to a load carrying system for use in building construction, in particular, to a vertically adjustable load carrying bracket.

In the construction of commercial buildings such as factories, warehouses, stores, office buildings, etc., a common technique is to first construct a steel frame with vertical steel columns and mount wall panels on the columns. These panels may be very heavy and may, for instance, be precast concrete units. After the heavy panels are mounted on the columns by a crane, it is frequently necessary to make some minor adjustments in the alignment and this may require lifting of precast concrete units. It is very time consuming of a central crane if it is used for the fine adjustments of the concrete units.

It is the object of the present invention to provide a simple support system for heavy loads, such as precast concrete panels, which will permit adjustments to the location of the panels after they have been mounted on support columns.

SUMMARY OF THE INVENTION

The present invention in its broadest aspect relates to an adjustable support bracket assembly for supporting a building wall panel or other heavy article on a vertical support structure. The assembly comprises a pivot pin fixed to the vertical support structure. A substantially horizontal support member is pivotally supported at the inner end thereof on the above pivot pin and has a load bearing portion extending outwardly beyond the outer edge of the vertical support structure. This support member also includes a pivot arm portion projecting upwardly or downwardly from the horizontal portion and having a threaded hole in the pivot arm portion remote from the horizontal portion. A threaded bolt is mounted in the threaded hole of the pivot arm and this bolt is adapted to engage the vertical support structure such that rotation of the bolt results in upward or downward movement of the load bearing portion.

According to one embodiment of the invention, the vertical support structure is a vertical column and the pivot pin is welded to an inner edge face of the column, with the portion of the pin projecting laterally beyond an edge of the column. The pivot pin may extend across between a pair of closely spaced columns or it may extend laterally outwardly on each side of a single column. According to another embodiment the pivot pin is mounted in a housing embedded in a side face of a vertical concrete wall.

According to one preferred embodiment, the horizontal support member has a recess in the inner end thereof for receiving the pivot pin. According to another preferred embodiment, the horizontal support member has a recess in the bottom thereof for receiving the pivot pin.

According to another preferred embodiment, the threaded hole extends through a rotatable steel dowel perpendicular to the axis.

BRIEF DESCRIPTION OF THE DRAWINGS

The invention is described by way of example, with reference to the accompanying drawings, which schematically illustrate and wherein.

Figure 1:
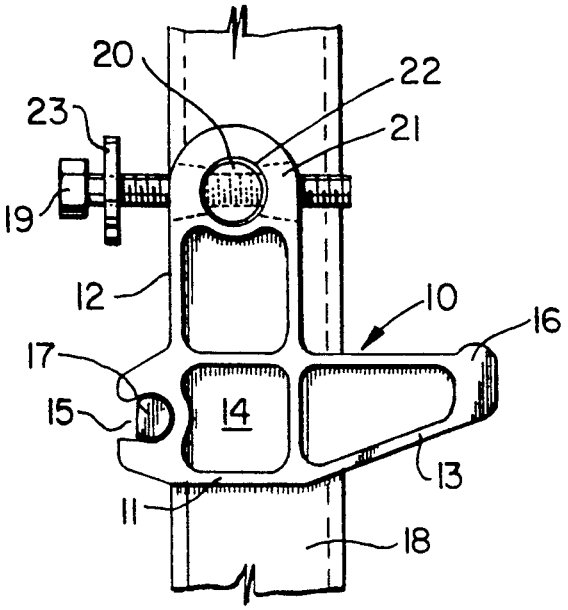
FIG. 1 is a side elevation of one embodiment of the invention.
Figure 2:
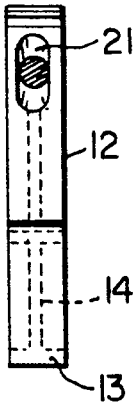
FIG. 2 is an end elevation of the assembly of FIG. 1.
Figure 3:
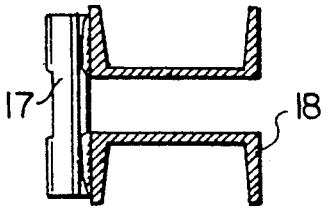
FIG. 3 is a sectional view of the column of FIG. 1.
Figure 4:
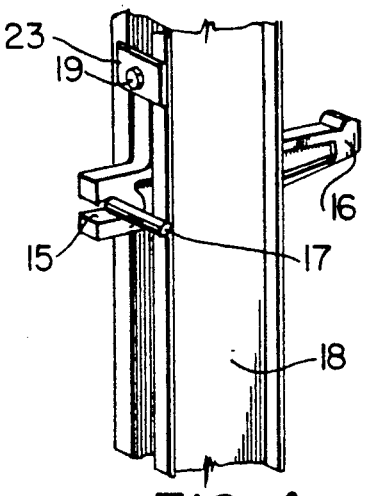
FIG. 4 is a perspective view of the embodiment of FIG. 1.

In the embodiment shown in FIGS. 1 to 4, a pair of channels 18 are placed back to back with a space therebetween. A pivot pin 17 is welded to the flanges of the two columns 18 so that a portion of the pivot pin 17 is free between the two channels.

A support member 10 comprises a horizontal portion 11 and a vertical pivot arm 12. The horizontal portion and pivot arm are each formed with a wide edge flange portion 13 substantially the width of the gap between the channel members 18 and central web portions 14. At the inner end of the horizontal portion 11 is a rounded recess 15 adapted to rotatably fit onto pivot pin 17. The opposite end of the horizontal portion comprises a load bearing portion 16 which may, for instance, rest within a notch or slot in a wall panel.

The pivot arm 12 includes at the upper end thereof a slot 21 which extends parallel to the support member horizontal portion 11 and a circular hole 22 perpendicular to the slot. Positioned within the hole 22 is a rotatable steel dowel 20 with a threaded hole. This threaded hole receives a threaded bolt 19 and by turning the bolt 19 inwardly against the load plate 23, the pivot arm 12 is caused to move in an inward direction, thereby raising the load bearing portion 16.

Figure 5:
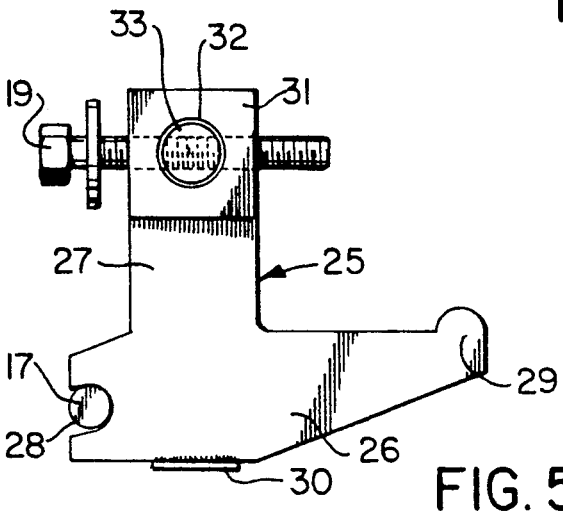
FIG. 5 is a side elevation of a further embodiment.
Figure 6:
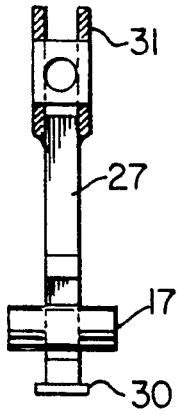
FIG. 6 is an end elevation in partial section of the embodiment of FIG. 5.

In the arrangement shown in FIGS. 5 and 6, the support member 25 is formed from a heavy steel plate and has a horizontal portion 26 and a vertical pivot arm portion 27. The inner face of the support member 25 has a rounded recess 28 for receiving pivot pin 17, while the outer end includes a load bearing portion 29.

A spacer bar 30 is welded to the bottom face of the steel plate and this spacer bar serves to hold the steel plate 25 centrally between a pair of back-to-back channel members forming a column.

The upper end of pivot arm 27 includes a pair of plate members 31 fixed to the two side faces of the pivot arm portion 27. A hole 32 extends across through the side plates 31 and mounted in this hole is a steel dowel 33 with a threaded hole extended therethrough. A threaded bolt 19 extends through the dowel 33 and permits adjustment of the load bearing portion 29 upwardly and downwardly in the same manner as described for FIG. 1.

Figure 7:
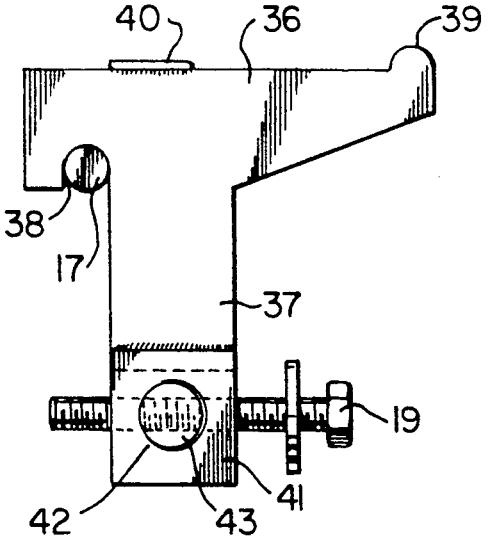
FIG. 7 is a side elevation of a further embodiment.

FIG. 7 shows an embodiment in which the support member has a horizontal portion 36 and a downwardly extending pivot arm 37. A rounded recess 38 is provided in a bottom face of the horizontal portion 36 for rotatably resting on pivot pin 17 and the outer end of the horizontal portion 36 includes a load bearing portion 39. A spacer bar 40 is welded to the top face of horizontal portion 36 for centrally locating the support member between two channels of a column.

The pivot arm 37 has a pair of side plates 41 with a hole 42 extending across therethrough. Mounted within this hole is a steel dowel 43 with a threaded hole therein. Threaded bolt passes through the threaded hole in dowel 43 and by rotation of the threaded bolt 19, the load bearing portion 39 can be moved upwardly and downwardly.

Figure 8:
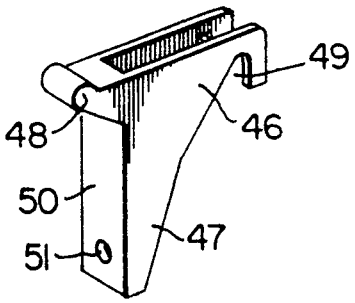
FIG. 8 is a perspective view of a further embodiment of bracket with two side arms.
Figure 9:
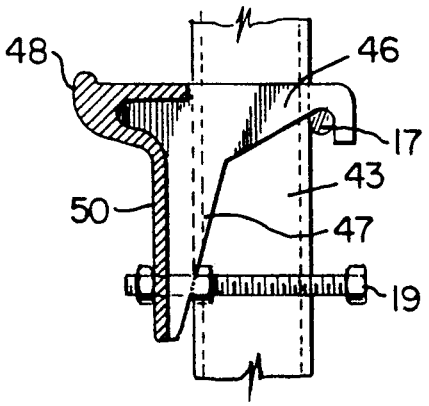
FIG. 9 is a side elevation in partial section of the bracket of FIG. 8.

A form of support member for fitting around a single column is shown in FIG. 8. This design includes a pair of side horizontal arms 46 and a pair of downwardly extending pivot arms 47 joined by a central web portion 50. The horizontal portions have in a bottom face rounded recesses 49 for resting on and receiving pivot pin 17. The opposite end of the horizontal portion 46 includes a load bearing portion 48.

A hole 51 is provided in web 50 for receiving threaded bolt 19. Rotation of the bolt 19 causes the load bearing portion 48 to move upwardly or downwardly as desired.

Figure 10:
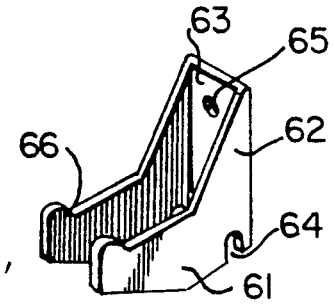
FIG. 10 is a perspective view of a further bracket with two side arms.
Figure 11:
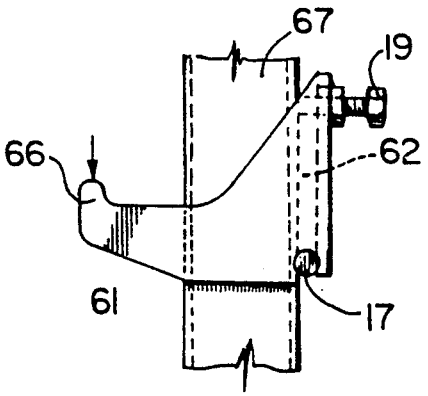
FIG. 11 is a side elevation of the bracket of FIG. 10.

Another double arm support member is shown in FIG. 10, this having two horizontal side arms 61 and upwardly extending pivot arms 62 joined by a central web 63. The bottom face of the horizontal portion 61 includes rounded recesses 64 for resting on pivot pin 17 and load bearing portions 66 on the outer ends of the horizontal portions 61. The central web 63 includes a hole 65 through which passes a threaded bolt 19. By engaging with the column 67, the threaded bolt 19 may be rotated to move the load bearing portion 66 upwardly or downwardly.

Figure 12:
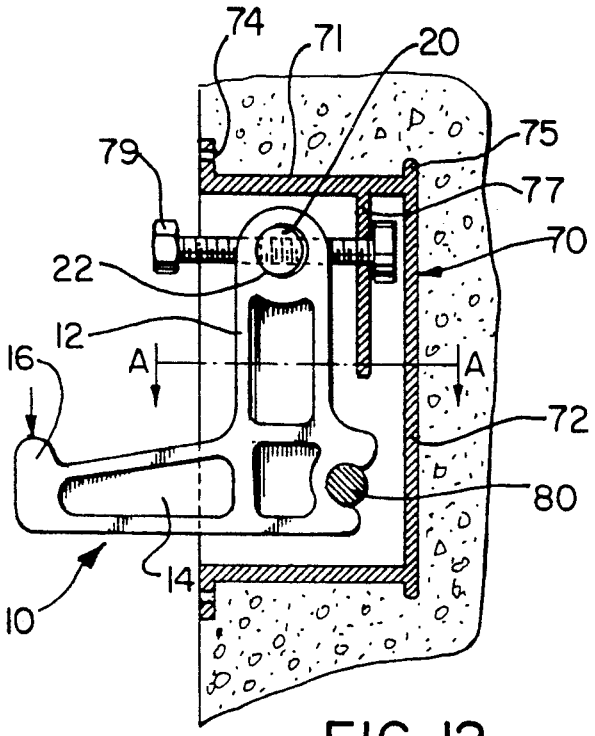
FIG. 12 is a side elevation in partial section of a further embodiment of the invention.
Figure 13:
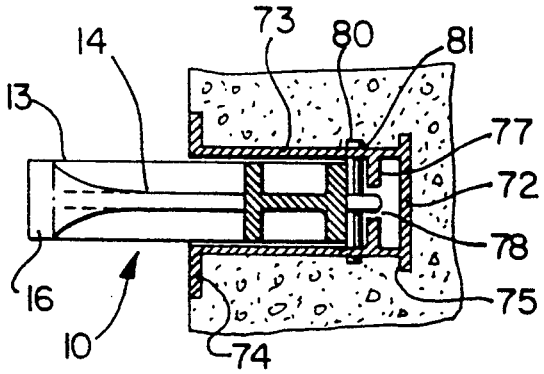
FIG. 13 is a sectional view of FIG. 12 along line A—A.

An alternative arrangement for supporting the pivot pin is shown in FIGS. 12 and 13. A metal housing 70 has top and bottom walls 71, inner end wall 72 and side walls 73. It includes brackets 74 for fixing to formwork and a projecting lip 75 for anchoring in concrete.

A pair of projections 77 extend down adjacent side walls 73 forming a slot 78 therebetween. This slot holds the inner end of bolt 79.

A pivotal support member 10 of the same design as shown in FIG. 1 is pivotally mounted on pivot pin 80 extending through holes 81 in housing 70. The bolt 79 passes through a threaded hole in dowel 20 mounted in hole 22 and rotation of the bolt causes upward or downward movement of load bearing portion 16.

I claim:

1. An adjustable support bracket assembly for supporting a building wall panel on a vertical support column comprising a pivot pin fixed to and extending across between a pair of closely spaced vertical support columns, a substantially horizontal support member pivotally supported at the inner end thereof on said pivot pin between said support columns and have a load bearing portion thereof extending outwardly beyond the outer edge of said vertical support column and said support member including a pivot arm portion projecting upwardly or downwardly from said horizontal portion and having a threaded hole therein remote from said horizontal portion and a threaded bolt mounted in said threaded hole, said bolt being adapted to engage the vertical support column such that rotation of said bolt results in upwardly or downward movement of said load bearing portion.

2. An assembly according to claim 1 wherein said horizontal support member has a recess in the inner end thereof for receiving said pivot pin.

3. An adjustable support bracket assembly for supporting a building wall panel on a vertical support column comprising a pivot pin fixed to and extending laterally on each side of a vertical support column, a substantially horizontal support member having support portions thereof on each side of said column pivotally supported at the inner end thereof on said pivot pin and have a load bearing portion thereof extending outwardly beyond the outer edge of said vertical support column and said support member including a pivot arm portion projecting upwardly or downwardly from said horizontal portion and having a threaded hole therein remote from said horizontal portion and a threaded bolt mounted in said threaded hole, said bolt being adapted to engage the vertical support column such that rotation of said bolt results in upwardly or downward movement of said load bearing portion.

4. An adjustable support bracket assembly for supporting a building all panel on a vertical support column comprising a pivot pin fixed to a vertical support column, a substantially horizontal support member pivotally supported at the inner end thereof on said pivot pin and have a load bearing portion thereof extending outwardly beyond the outer edge of said vertical support column and said support member including a pivot arm portion projecting upwardly or downwardly from said horizontal portion and having a threaded hole therein remote from said horizontal portion, said threaded hole passing through a steel dowel, rotatably mounted in the pivot arm, perpendicular to the axis thereof, and a threaded bolt mounted in said threaded hole, said bolt being adapted to engage the vertical support column such that rotation of said bolt results in upwardly or downward movement of said load bearing portion.

* * * * *